US009194051B2

(12) United States Patent
Andrén et al.

(10) Patent No.: US 9,194,051 B2
(45) Date of Patent: Nov. 24, 2015

(54) METHOD AND APPARATUS FOR PREPARING A MOTHER PLATE OF A PERMANENT CATHODE FOR AN ELECTROLYTIC PROCESS

(75) Inventors: Henrik Andrén, Valberg (SE); Martin Arpi, Kil (SE)

(73) Assignee: OUTOTEC OYJ, Espoo (FI)

( * ) Notice: Subject to any disclaimer, the term of this patent is extended or adjusted under 35 U.S.C. 154(b) by 424 days.

(21) Appl. No.: 13/381,089

(22) PCT Filed: Jun. 30, 2010

(86) PCT No.: PCT/FI2010/050563

§ 371 (c)(1),
(2), (4) Date: Dec. 27, 2011

(87) PCT Pub. No.: WO2011/001032

PCT Pub. Date: Jan. 6, 2011

(65) Prior Publication Data

US 2012/0096913 A1 Apr. 26, 2012

(30) Foreign Application Priority Data

Jun. 30, 2009 (FI) ..... 20095740

(51) Int. Cl.
*C25C 7/02* (2006.01)

(52) U.S. Cl.
CPC ..... *C25C 7/02* (2013.01)

(58) Field of Classification Search
CPC ..... B21D 1/06; B21D 1/00; B21D 1/02; C25C 7/02; B25B 5/145
USPC ..... 72/18.2, 381, 383, 384, 394, 396, 399, 72/400, 295, 296, 305; 100/35; 29/406, 29/407.01, 407.05, 407.08, 407.09; 33/533, 552, 549, 551
See application file for complete search history.

(56) References Cited

U.S. PATENT DOCUMENTS 3,889,513 A * 6/1975 Iwasaki et al. ..... 72/385
4,413,495 A * 11/1983 Peuhkurinen et al. ..... 72/196
(Continued)

FOREIGN PATENT DOCUMENTS

CA 1312748 1/1993
CL 49822 1/2007
(Continued)

OTHER PUBLICATIONS

Chinese Office Action issued Dec. 5, 2013 to include Chinese Search Report issued Nov. 25, 2013 for Chinese Application No. 201080029484.2 (with English translation), 18 pages.
(Continued)

*Primary Examiner* — Shelley Self
*Assistant Examiner* — Gregory Swiatocha
(74) *Attorney, Agent, or Firm* — Chernoff Vilhauer McClung & Stenzel LLP

(57) ABSTRACT

The invention relates to a method and an apparatus for preparing a mother plate of a permanent cathode to be used in a process for electrolytic recovery of metal such as metal electrorefining or metal electrowinning. The apparatus comprises a holder for releasably holding the permanent cathode, a measurer for measuring a shape of the mother plate to obtain measurement data, a calculating device functionally connected with the measurer and configured for calculating geometric deviation of the mother plate in comparison to a predefined reference shape by using the measurement data, and a presser functionally connected with the calculating device and configured for automatically locally pressing the mother plate in accordance with the calculated geometric deviation of the mother plate to plastically deform the mother plate.

8 Claims, 2 Drawing Sheets

(56) References Cited

U.S. PATENT DOCUMENTS

Figure 1:
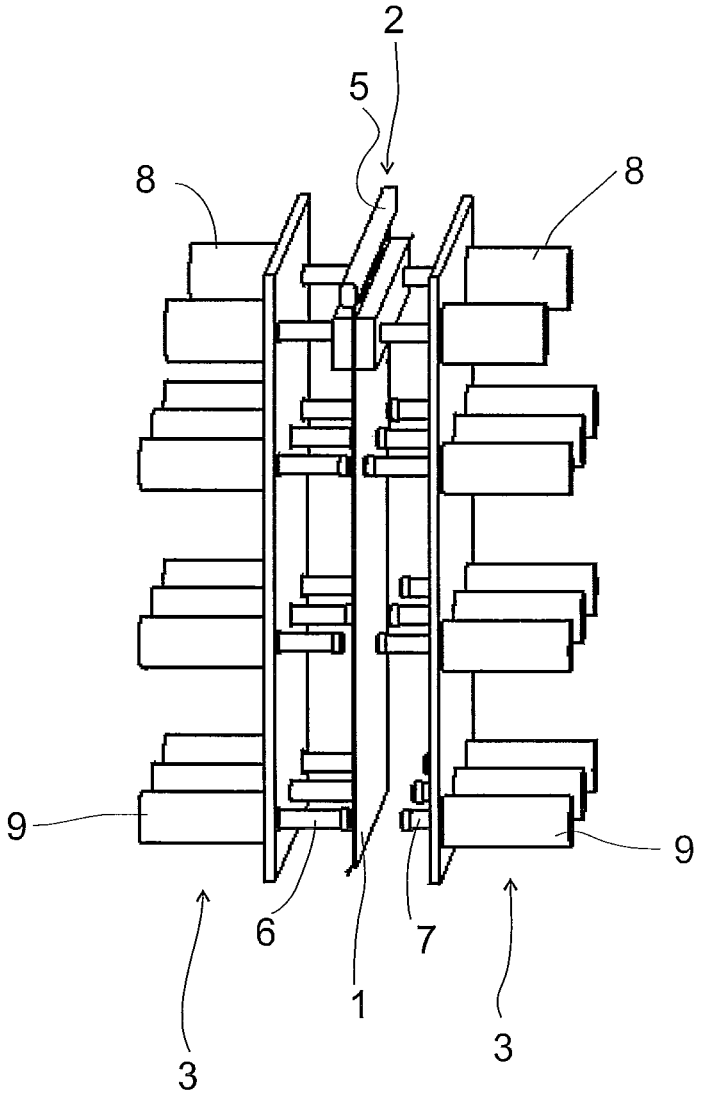

| | | | | |
|---|---|---|---|---|
| 4,667,501 | A | 5/1987 | Martin | |
| 4,903,519 | A * | 2/1990 | Hukkanen et al. | 72/309 |
| 4,903,520 | A | 2/1990 | Hukkanen et al. | |
| 5,617,643 | A * | 4/1997 | Kato et al. | 33/533 |
| 5,802,901 | A | 9/1998 | Oda et al. | |
| 6,254,744 | B1 * | 7/2001 | Larsson | 204/286.1 |
| 2007/0184356 | A1 * | 8/2007 | Akiyama et al. | 430/5 |

FOREIGN PATENT DOCUMENTS

| | | | |
|---|---|---|---|
| CL | 201103289 | | 4/2012 |
| CN | 1137952 | A | 12/1996 |
| CN | 101611175 | A | 12/2009 |
| GB | 1388069 | | 3/1975 |
| JP | 61009926 | A | 1/1986 |
| JP | 10130877 | A | 5/1998 |
| JP | 11256387 | A * | 9/1999 |
| JP | 2001041737 | A | 2/2001 |
| JP | 11256387 | | 9/2011 |

OTHER PUBLICATIONS

Pirjo Kauraala, International Search Report for PCT/F12010/050563, Oct. 13, 2010.

Swedish Office Action for Patent Application No. 1250042-7, mailed Mar. 12, 2014, 5 pages.

Chilean Search Report for issued May 15, 2014 for PCT/2011-003324 filed Dec. 28, 2011, 11 pages.

* cited by examiner

METHOD AND APPARATUS FOR PREPARING A MOTHER PLATE OF A PERMANENT CATHODE FOR AN ELECTROLYTIC PROCESS

This is a national stage application filed under 35 USC 371 based on International Application No. PCT/FI2010/050563 filed Jun. 30, 2010 and claims priority under 35 USC 119 of Finnish Patent Application No. FI 20095740 filed Jun. 30, 2009.

FIELD OF THE INVENTION

The invention relates to a method for preparing a mother plate of a permanent cathode to be used in a process for electrolytic recovery of metal such as metal electrorefining or metal electrowinning as defined herein.

The invention also relates to an apparatus for preparing a mother plate of a permanent cathode to be used in a process for electrolytic recovery of metal such as metal electrorefining or metal electrowinning as defined herein.

The invention relates more precisely to a method and apparatus for automatically flattening and leveling mother plates of permanent cathodes used in electrolytic recovery of metals such as zinc, copper or lead. A mother plate of a permanent cathode can for example be deformed when metal deposit is removed from the faces of the mother plate of the permanent cathode.

One known method for flattening and leveling mother plates of permanent cathode is by rolling. Because permanent cathodes normally are provided with a hanger bar for supporting the permanent cathode on the edges on an electrolytic cell so that the mother plate of the permanent cathode is sank in the electrolyte in the electrolytic cell, flattening and leveling of a mother plate by rolling is difficult to perform.

Publication U.S. Pat. No. 4,903,519 presents a method and an apparatus for straightening of cast anodes on their way to a stage for electrolytic refining of metals. The straightening of the anodes and the elimination of the casting fins is carried out by pressing the anode at several spots or spot areas simultaneously. The apparatus includes a pressing member formed of horizontal and vertical bars. The adjacent ends of the horizontal and vertical bars form at least one of a 45 .degree. miter joint configuration or are right-angled.

OBJECTIVE OF THE INVENTION

The object of the invention is to provide a method and an apparatus for preparing a mother plate of a permanent cathode to be used in a process for electrolytic recovery of metal.

SHORT DESCRIPTION OF THE INVENTION

The method for preparing a mother plate of a permanent cathode to be used in a process for electrolytic recovery of metal such as metal electrorefining or metal electrowinning of the invention is characterized by the definitions of independent claim 1.

The invention is based on releasably holding the permanent cathode with a holding means and on measuring a shape of the mother plate with a measurement means to obtain measurement data, and on calculating geometric deviation of the mother plate in comparison to a predefined reference shape by using said measurement data, and on using said geometric deviation for automatically controlling a pressing means for locally pressing the mother plate of the permanent cathode for plastically deforming the mother plate to at least partly obtain a reference shape for the mother plate. Because the mother plate of the permanent cathode is locally pressed the mother plate can easily be straightened without detaching its hanger bar for supporting the permanent cathode at an electrolytic cell. Local pressing allows also for straightening of a mother plate in situations where edge strips are attached to the mother plate. Possible edge strips are however preferably removed.

In a preferred embodiment of the method of the invention a pressing means is used that comprises several pressing devices, each being configured for applying a linear pressing force essentially perpendicularly to one of the faces of the mother plate at a different location of the mother plate for plastically deforming the mother plate to at least partly obtain a reference shape for the mother plate. In this preferred embodiment of the method of the invention the mother plate is pressed with at least one of said several pressing devices of the pressing means by applying a linear pressing force essentially perpendicularly to one of the faces of the mother plate for plastically deforming the mother plate to at least partly obtain a reference shape for the mother plate.

In a preferred embodiment of the method of the invention a pressing means is used that comprises several independently operable pressing devices, each being configured for applying a linear pressing force essentially perpendicularly to one of the faces of the mother plate at a different location of the mother plate for plastically deforming the mother plate to at least partly obtain a reference shape for the mother plate. In this preferred embodiment of the method of the invention the mother plate is pressed with at least one of said several independently operable pressing devices of the pressing means by applying a linear pressing force essentially perpendicularly to one of the faces of the mother plate for plastically deforming the mother plate to at least partly obtain a reference shape for the mother plate.

In a preferred embodiment of the apparatus of the invention the pressing means comprises several pressing devices, each pressing devices being configured linearly and perpendicularly in relation to the faces of the mother plate pressing the mother plate at a different location of the mother plate for plastically deforming the mother plate to at least partly obtain a reference shape for the mother plate. In this preferred embodiment of the apparatus of the invention each pressing device comprises a first piston arrangement that is configured to co-operate with a pressing device comprising a second piston arrangement so that the mother plate can be held between at least one first piston arrangement of a pressing device and at least one second piston arrangement of a pressing device when the mother plate is plastically deformed to at least partly obtain a reference shape for the mother plate. In this preferred embodiment of the apparatus of the invention the apparatus can for example comprise eighteen pressing devices so that nine pressing devices are configured to be situated at a first side of the mother plate and so that nine pressing devices are configured to be situated at a second side of the mother plate.

In a preferred embodiment of the apparatus of the invention the pressing means comprises several independently operable pressing devices, each independently operable pressing devices being configured linearly and perpendicularly in relation to the faces of the mother plate pressing the mother plate at a different location of the mother plate for plastically deforming the mother plate to at least partly obtain a reference shape for the mother plate. In this preferred embodiment of the apparatus of the invention each independently operable pressing device comprises a first independently operable piston arrangement that is configured to co-operate with a independently operable pressing device comprising a second independently operable piston arrangement so that the mother plate can be held between at least one first independently operable piston arrangement of a pressing device and at least one second independently operable piston arrangement of a independently operable pressing device when the mother plate is plastically deformed to at least partly obtain a reference shape for the mother plate. In this preferred embodiment of the apparatus of the invention the apparatus can for example comprise eighteen independently operable pressing devices so that nine independently operable pressing devices are configured to be situated at a first side of the mother plate and so that nine independently operable pressing devices are configured to be situated at a second side of the mother plate.

LIST OF FIGURES

Figure 2:
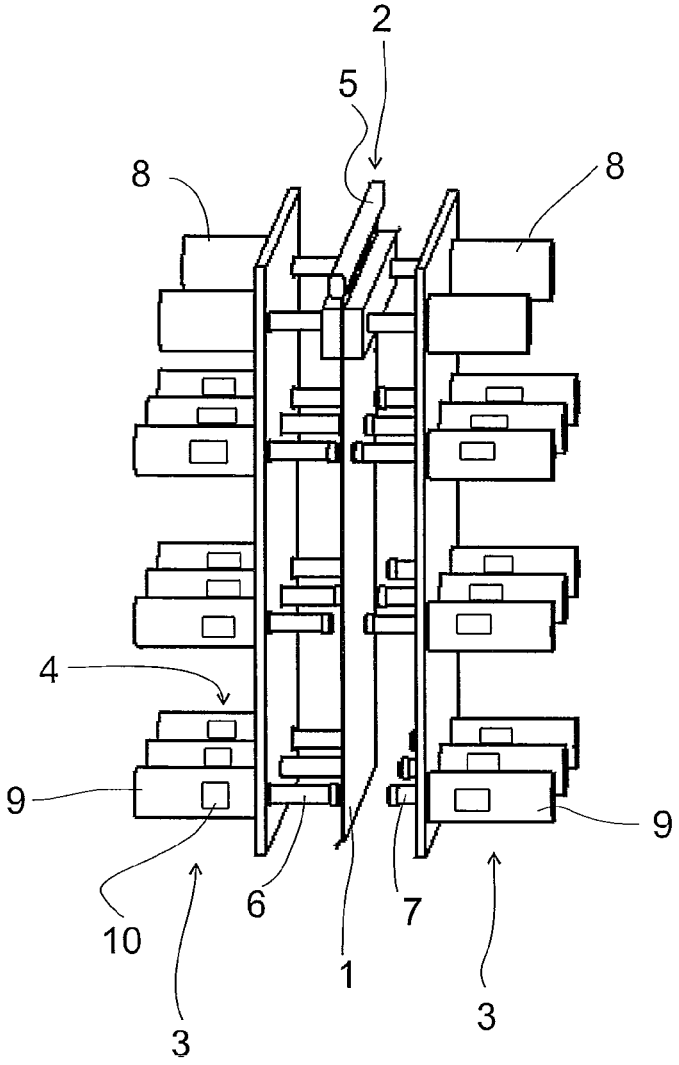

In the following the invention will be described in more detail by referring to the figures. FIG. 1 shows the working principle of a preferred embodiment of the invention. FIG. 2 shows the working principle of another preferred embodiment of the invention with a measuring device.

DETAILED DESCRIPTION OF THE INVENTION

The FIGURE shows an example of a method and an apparatus according to the invention.

First the method for preparing a mother plate 1 of a permanent cathode 2 to be used in a process for electrolytic recovery of metal such as metal electrorefining or metal electrowinning and preferred variations thereof will be described.

The mother plate 1 is an object in the form of a plate that has two opposite faces (not marked with a reference numeral) on which metal is collected in a process for electrolytic recovery of metal such as metal electrorefining or metal electrowinning.

The method comprises a step for releasably holding the permanent cathode 2.

The method comprises a step for measuring a shape of the mother plate 1 of a permanent cathode 2 with a measurement device to obtain measurement data.

The method comprises a step for calculating geometric deviation of the mother plate 1 in comparison to a predefined reference shape by using said measurement data.

The method comprises a step for using said calculated geometric deviation for automatically controlling a pressing means 3 for locally pressing the mother plate 1 for plastically deforming the mother plate 1 to at least partly obtain a reference shape for the mother plate 1. A reference shape means in this context the ideal shape of the mother plate 1. To at least partly obtain a reference shape for the mother plate 1 means in this context to obtain such shape for the mother plate 1 such that the geometric deviation of the mother plate 1 falls between certain tolerances such that the mother plate 1 is capable of performing its task in the process for electrolytic recovery of metals.

The method may comprise a step for releasably holding the permanent cathode 2 at an end of the permanent cathode 2 provided with a hanger bar 5 for supporting the permanent cathode 2 at an electrolytic cell during a process for electrolytic recovery of metal.

The method may comprise a step for pressing the mother plate 1 by means of the pressing means 3 to plastically deforming the mother plate 1 to at least partly obtain a reference shape for at least part of the mother plate 1 if said geometric deviation exceeds a predefined value. This step is optional, because it might be that the shape of the mother plate 1 is such that no plastic deformation is needed. It might for example be that the mother plate 1 is found to be flat enough after the calculating so that no plastic deformation of the mother plate 1 need to be performed.

The method comprises preferably, but not necessarily, locally pressing the mother plate 1 by means of the pressing means 3 by applying pressing force essentially perpendicularly and linearly to one of the faces of the mother plate 1.

The method comprises preferably, but not necessarily, a step for using a measurement means 4 comprising a laser measuring system for remotely measuring a shape of the mother plate 1 to obtain said measurement data. Alternatively or additionally the method may comprise a step for using a measurement means 4 comprising a measuring system, which function is based on touching the mother plate 1 to obtain said measurement data.

The method comprises preferably, but not necessarily, as shown in the FIGURE a step for measuring a shape of the mother plate 1 at several locations of the mother plate 1, and a step for pressing the mother plate 1 at several locations of the mother plate 1 for plastically deforming the mother plate 1 to at least partly obtain a reference shape for the mother plate 1. More precisely, the method shown in the FIGURE comprises a step for measuring a shape of the mother plate 1 at nine locations of the mother plate 1 and using a pressing means 3 comprising eighteen pressure devices 9 making it possible to press the mother plate at eighteen different locations, because the pressing means 3 comprises eighteen pressure devices each comprising a piston arrangement; nine first piston arrangements 6 arranged at a first side of the mother plate 1 for pressing the mother plate 1 independently at nine locations from the first side of the mother plate 1 and nine second piston arrangements 7 arranged at an opposite second side of the mother plate 1 for pressing the mother plate 1 independently at nine locations from the opposite second side of the mother plate 1.

The method comprises preferably, but not necessarily, as shown in the FIGURE a step for measuring a shape of the mother plate 1 at several different locations of the mother plate 1, and a step for pressing a face the mother plate 1 at several different locations of the mother plate 1 for plastically deforming the mother plate 1 to at least partly obtain a reference shape for the mother plate 1. More precisely, the method shown in the FIGURE comprises a step for measuring a shape of the mother plate 1 at nine different locations of the mother plate 1 and using a pressing means 3 comprising eighteen independently operable pressure devices 9 making it possible to press a face of the mother plate independently at eighteen different locations, because the pressing means 3 comprises eighteen pressure devices 9 each comprising an independently operable piston arrangement 6; nine first independently operable piston arrangements 6 arranged at a first side of the mother plate 1 for pressing a face the mother plate 1 independently at nine locations from the first side of the mother plate 1 and nine second independently operable piston arrangements 7 arranged at an opposite second side of the mother plate 1 for pressing a face the mother plate 1 independently at nine locations from the opposite second side of the mother plate 1.

The method may comprise a step for after plastically deforming the mother plate 1 of the permanent cathode 2 by means of the pressing means 3 performing a step for measuring a shape of the mother plate 1 with a measurement device to obtain verification data, and a step for calculating geometric deviation of the mother plate 1 in comparison to a predefined reference shape by using said verification data, and a step for using said geometric deviation for automatically controlling a pressing means 3 for pressing the mother plate 1 for plastically deforming the mother plate 1 to at least partly obtain a reference shape for the mother plate 1.

The invention relates also to an apparatus for preparing a mother plate 1 of a permanent cathode 2 to be used in a process for electrolytic recovery of metal such as metal electrorefining or metal electrowinning.

The mother plate 1 is an object in the form of a plate that has two opposite faces (not marked with a reference numeral) on which metal is collected in a process for electrolytic recovery of metal such as metal electrorefining or metal electrowinning.

The apparatus comprises a holding means 8 for releasably holding the permanent cathode 2.

The apparatus comprises a measurement means 4 for measuring a shape of the mother plate 1 with a measurement device to obtain measurement data.

The apparatus comprises a calculating means functionally connected with the measurement means 4, said calculating means being configured for calculating geometric deviation of the mother plate 1 in comparison to a predefined reference shape by using said measurement data.

The apparatus comprises a pressing means 3 functionally connected with the calculating means and configured for locally automatically pressing the mother plate 1 in accordance with the calculated geometric deviation of the mother plate 1 to plastically deform the mother plate 1 to at least partly obtain a reference shape for the mother plate 1. A reference shape means in this context the ideal shape of the mother plate 1. To at least partly obtain a reference shape for the mother plate 1 means in this context to obtain such shape for the mother plate 1 such that the geometric deviation of the mother plate 1 falls between certain tolerances such that the mother plate 1 is capable of performing its task in the process for electrolytic recovery of metals.

The holding means 8 are preferably, but not necessarily, configured for holding the permanent cathode 2 at an end of the permanent cathode 2 provided with a hanger bar 5 for supporting the permanent cathode 2 at an electrolytic cell (not shown in the FIGURE).

The pressing means 3 are preferably, but not necessarily, configured for locally pressing the mother plate 1 by applying pressing force essentially perpendicularly to one of the faces of the mother plate 1.

The measurement means 4 comprises preferably, but not necessarily, a laser measuring system (not marked with a reference number) for remotely measuring a shape of the mother plate 1 to obtain said measurement data.

In the FIGURE the pressing means 3 of the apparatus comprises pressing devices 9 each having a first piston arrangement 6 for linearly pressing the mother plate 1 of the permanent cathode 2 from a first side of the mother plate 1 of the permanent cathode 2 essentially perpendicularly in relation to the first face of the mother plate 1 of the permanent cathode 2 and pressing devices 9 each having a second piston arrangement 7 for pressing the mother plate 1 of the permanent cathode 2 from an opposite second side of the mother plate 1 of the permanent cathode 2 essentially perpendicularly in relation to the opposite second face of the mother plate 1 of the permanent cathode 2.

If the apparatus comprises pressing devices 9, each having a first piston arrangement 6 for linearly pressing the mother plate 1 of the permanent cathode 2 from a first side of the mother plate 1 of the permanent cathode 2 essentially perpendicularly in relation to the first face of the mother plate 1 of the permanent cathode 2 and pressing devices 9, each having a second piston arrangement 7 for linearly pressing the mother plate 1 of the permanent cathode 2 from an opposite second side of the mother plate 1 of the permanent cathode 2 essentially perpendicularly in relation to the opposite second face of the mother plate 1 of the permanent cathode 2, the first piston arrangement 6 is preferably, but not necessarily, configured to co-operate with the second piston arrangement 7 so that the mother plate 1 is held between the first piston arrangement 6 and the second piston arrangement 7 when the mother plate 1 is plastically deformed to at least partly obtain a reference shape for the mother plate 1.

The measurement means 4 of the apparatus comprises preferably, but not necessarily, several measurement devices 10 each being configured for measuring the shape of part of the mother plate 1. In the figures the measurement means 4 comprises nine measurement devices 10.

The pressing means 3 of the apparatus comprises preferably, but not necessarily, several pressing devices 9 each being configured for pressing the mother plate 1 at a different location of the mother plate 1 for plastically deforming the mother plate 1 to at least partly obtain a reference shape for the mother plate 1. The pressing means 3 of the apparatus shown in the FIGURE comprises eighteen pressing devices 9, which are arranged as nine pressing devices 9 each having a first piston arrangement 6 for linearly pressing the mother plate 1 of the permanent cathode 2 from a first side of the mother plate 1 of the permanent cathode 2 essentially perpendicularly in relation to the first side of the mother plate 1 of the permanent cathode 2 and as nine pressing devices 9 each having a second piston arrangement 7 for linearly pressing the mother plate 1 of the permanent cathode 2 from an opposite second side of the mother plate 1 of the permanent cathode 2 essentially perpendicularly in relation to the opposite second side of the mother plate 1 of the permanent cathode 2.

The pressing means 3 of the apparatus comprises preferably, but not necessarily, several independently operable pressing devices 9 each being configured for pressing a face the mother plate 1 at a different location of the mother plate 1 for plastically deforming the mother plate 1 to at least partly obtain a reference shape for the mother plate 1. The pressing means 3 of the apparatus shown in the FIGURE comprises eighteen independently operable pressing devices 9, which are arranged as nine independently operable pressing devices 9 each having a first independently operable piston arrangement 6 for linearly pressing a first face of the mother plate 1 of the permanent cathode 2 from a first side of the mother plate 1 of the permanent cathode 2 essentially perpendicularly in relation to the first face of the mother plate 1 of the permanent cathode 2 and as nine independently operable pressing devices 9 each having a second independently operable piston arrangement 7 for linearly pressing a opposite second face of the mother plate 1 of the permanent cathode 2 from an opposite second side of the mother plate 1 of the permanent cathode 2 essentially perpendicularly in relation to the opposite second face of the mother plate 1 of the permanent cathode 2.

If the apparatus comprises a first piston arrangement 6 for linearly pressing the mother plate 1 of the permanent cathode 2 from a first side of the mother plate 1 of the permanent cathode 2 and a second piston arrangement 7 for linearly pressing the mother plate 1 of the permanent cathode 2 from an opposite second side of the mother plate 1 of the permanent cathode 2, the first piston arrangement 6 is preferably, but not necessarily, configured to co-operate with the second piston arrangement 7 so that the mother plate 1 is held between the first piston arrangement 6 and the second piston arrangement 7 when the mother plate 1 is plastically deformed to at least partly obtain a reference shape for the mother plate 1.

If the apparatus comprises several co-operating first piston arrangements 6 and second piston arrangements 7, the apparatus is preferably, but not necessarily, configured for holding the mother plate 1 in place between a co-operating first piston arrangement 6 and second piston arrangement 7 when the mother plate 1 is plastically deformed with another co-operating first piston arrangement 6 and another second piston arrangement 7 to at least partly obtain a reference shape for the mother plate 1.

If the apparatus comprises several co-operating first independently operable piston arrangements 6 and second independently operable piston arrangements 7, the apparatus is preferably, but not necessarily, configured for holding the mother plate 1 in place between a co-operating first independently operable piston arrangement 6 and second independently operable piston arrangement 7 when the mother plate 1 is plastically deformed with another co-operating first independently operable piston arrangement 6 and another second independently operable piston arrangement 7 to at least partly obtain a reference shape for the mother plate 1.

As mentioned, the pressing means 3 comprises preferably, but not necessarily, several pressing devices 9 each being configured for pressing the mother plate 1 at a different location of the mother plate 1 for plastically deforming the mother plate 1 to at least partly obtain a reference shape for the mother plate 1.

As mentioned, the pressing means 3 comprises preferably, but not necessarily, several independently operable pressing devices 9 each being configured for pressing a face the mother plate 1 at a different location of the mother plate 1 for plastically deforming the mother plate 1 to at least partly obtain a reference shape for the mother plate 1.

If the pressing means 3 comprises several pressing devices 9 each being configured for pressing the mother plate 1 at a different location of the mother plate 1 for plastically deforming the mother plate 1 to at least partly obtain a reference shape for the mother plate 1, each pressing device 9 comprises preferably, but not necessarily, a first piston arrangement 6 that is configured to co-operate with a pressing device 9 comprising a second piston arrangement 7 so that the mother plate 1 can be held between at least one first piston arrangement 6 of a pressing device 9 and at least one second piston arrangement 7 of a pressing device 9 when the mother plate 1 is plastically deformed to at least partly obtain a reference shape for the mother plate 1. In the FIGURE, the pressing means 3 comprises eighteen pressing devices 9 so that nine pressing devices 9 are configured to be situated at a first side of the mother plate 1 and so that nine pressing devices 9 are configured to be situated at a second side of the mother plate 1.

If the pressing means 3 comprises several independently operable pressing devices 9 each being configured for pressing a face the mother plate 1 at a different location of the mother plate 1 for plastically deforming the mother plate 1 to at least partly obtain a reference shape for the mother plate 1, each independently operable pressing device 9 comprises preferably, but not necessarily, a first independently operable piston arrangement 6 that is configured to co-operate with a independently operable pressing device 9 comprising a second independently operable piston arrangement 7 so that the mother plate 1 can be held between at least one first independently operable piston arrangement 6 of an independently operable pressing device 9 and at least one second independently operable piston arrangement 7 of an independently operable pressing device 9 when the mother plate 1 is plastically deformed to at least partly obtain a reference shape for the mother plate 1. In the FIGURE, the pressing means 3 comprises eighteen independently operable pressing devices 9 so that nine independently operable pressing devices 9 are configured to be situated at a first side of the mother plate 1 and so that nine independently operable pressing devices 9 are configured to be situated at a second side of the mother plate 1.

The measurement means 4, the pressing means 3, and the holding means 8 are preferably, but not necessarily, fixedly arranged in a frame means (not shown in the FIGURE).

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A method for preparing a mother plate of a permanent cathode to be used in a process for electrolytic recovery of metal, wherein the mother plate of the permanent cathode is in the form of a plate that has two opposite faces and wherein the method comprises steps for holding the permanent cathode with permanent cathode holders which are attached to a frame means by pressing the permanent cathode between the permanent cathode holders, measuring a shape of the mother plate of the permanent cathode with a mother plate measurement assembly that is attached to the frame means to obtain measurement data, calculating geometric deviation of the mother plate of the permanent cathode in comparison to a predefined reference shape by using said measurement data, using said geometric deviation for automatically controlling a mother plate pressing assembly that is attached to the frame means and that is configured to locally press the mother plate of the permanent cathode for plastically deforming the mother plate of the permanent cathode to at least partly obtain the predetermined reference shape for the mother plate of the permanent cathode, wherein the mother plate measurement assembly that is used in the method comprises several mother plate measurement devices, wherein each of said several mother plate measurement devices being configured to measure a shape of a part of the mother plate of the permanent cathode and wherein each of said several mother plate measurement devices being configured to obtain said measurement data of the shape of the part of the mother plate of the permanent cathode, wherein the mother plate pressing assembly that is used in the method comprises several independently operable mother plate pressing devices each being configured to apply a linear pressing force essentially perpendicularly to one of the faces of the mother plate of the permanent cathode at a location of the mother plate for plastically deforming the mother plate to at least partly obtain the predetermined reference shape for the mother plate of the permanent cathode, wherein the method comprises pressing one of the faces of the mother plate of the permanent cathode with at least one of said several mother plate pressing devices of the mother plate pressing assembly by applying the linear pressing force essentially perpendicularly to one of the faces of the mother plate of the permanent cathode to at least partly obtain the predetermined reference shape for the mother plate of the permanent cathode, wherein the method comprises holding the permanent cathode with the permanent cathode holders during the pressing of the mother plate by means of the mother plate pressing assembly solely at an end of the permanent cathode, which end of the permanent cathode is provided with a hanger bar for supporting the permanent cathode at an electrolytic cell, wherein the method comprises holding the permanent cathode with the permanent cathode holders so that the permanent cathode except for said end of the permanent cathode, which end of the permanent cathode is provided with the hanger bar, is unsupported by the permanent cathode holders during the pressing of the mother plate by means of the mother plate pressing assembly, and wherein the method comprises holding the permanent cathode with the permanent cathode holders both vertically and horizontally in position with respect to said frame means.

2. The method according to claim 1, wherein the method comprises after plastically deforming the mother plate of the permanent cathode by means of the mother plate pressing assembly measuring the shape of the mother plate of the permanent cathode to obtain verification data, calculating geometric deviation of the mother plate of the permanent cathode in comparison to the predefined reference shape by using said verification data, and using said geometric deviation for automatically controlling the mother plate pressing assembly to press the mother plate of the permanent cathode by means of the mother plate pressing assembly to plastically deform the mother plate of the permanent cathode to at least partly obtain said predefined reference shape for the mother plate of the permanent cathode.

3. An apparatus for preparing a mother plate of a permanent cathode to be used in a process for electrolytic recovery of metal, wherein the mother plate of the permanent cathode is in the form of a plate that has two opposite faces and wherein the apparatus comprises a frame means, permanent cathode holders attached to the frame means and configured to hold the permanent cathode by pressing the permanent cathode between the permanent cathode holders, a mother plate measurement assembly attached to the frame means and configured to measure a shape of the mother plate of the permanent cathode to obtain measurement data, a geometric deviation calculating device functionally connected with the mother plate measurement assembly and configured to calculate geometric deviation of the mother plate of the permanent cathode in comparison to a predefined reference shape by using said measurement data measured by said mother plate measurement assembly, and a mother plate pressing assembly attached to the frame means and functionally connected with the geometric deviation calculating device and configured to automatically locally press the mother plate of the permanent cathode in accordance with the calculated geometric deviation of the mother plate of the permanent cathode to plastically deform the mother plate of the permanent cathode to at least partly obtain the predetermined reference shape for the mother plate of the permanent cathode, wherein the mother plate measurement assembly comprising several mother plate measurement devices each being configured to measure a shape of a part of the mother plate of the permanent cathode, wherein the mother plate pressing assembly comprises several independently operable mother plate pressing devices, wherein each independently operable mother plate pressing device being configured to apply a linear pressing force essentially perpendicularly to one of the faces of the mother plate of the permanent cathode at a location of the mother plate for plastically deforming the mother plate of the permanent cathode to at least partly obtain the predetermined reference shape for the mother plate of the permanent cathode, wherein the permanent cathode holders being configured to hold the permanent cathode during the pressing of the mother plate by means of the mother plate pressing assembly solely at an end of the permanent cathode, which said end of the permanent cathode is provided with a hanger bar for supporting the permanent cathode at an electrolytic cell, wherein the permanent cathode holders being configured to hold the permanent cathode so that the permanent cathode except for said end of the permanent cathode, which end of the permanent cathode is provided with the hanger bar, is unsupported by the permanent cathode holders during the pressing of the mother plate by means of the mother plate pressing assembly, and wherein the permanent cathode holders being configured to hold the permanent cathode both vertically and horizontally in position with respect to said frame means during the pressing of the mother plate by means of the mother plate pressing assembly.

4. The apparatus according to claim 3, wherein each mother plate pressing device comprises a first piston arrangement and a second piston arrangement, and wherein in each mother plate pressing device the first piston arrangement is configured to co-operate with the second piston arrangement so that the mother plate is configured to be held between the first piston arrangement of the mother plate pressing device and the second piston arrangement of the mother plate pressing device when the mother plate is plastically deformed to at least partly obtain said predetermined reference shape for the mother plate.

5. The apparatus according to claim 3, wherein each mother plate pressing device comprises a first independently operable piston arrangement and a second independently operable piston arrangement, and wherein in each mother plate pressing device the first independently operable piston arrangement is configured to co-operate with the second independently operable piston arrangement so that the mother plate is configured to be held between the first piston arrangement of the mother plate pressing device and the second piston arrangement of the mother plate pressing device when the mother plate is plastically deformed to at least partly obtain the predetermined reference shape for the mother plate.

6. The apparatus according to claim 3, wherein the mother plate pressing assembly comprising eighteen pressing devices so that nine pressing devices are configured to be situated at a first side of the mother plate and so that nine pressing devices are configured to be situated at a second side of the mother plate.

7. The method according to claim 1 wherein the process for electrolytic recovery of metal is one of metal electrorefining and metal electrowinning.

8. The apparatus according to claim 3 wherein the process for electrolytic recovery of metal is one of metal electrorefining and metal electrowinning.

* * * * *